United States Patent [19]

Rice

[11] 4,021,029

[45] May 3, 1977

[54] SHADE MARKING MACHINE

[75] Inventor: George A. Rice, Palestine, Tex.

[73] Assignee: Work Wear Corporation, Cleveland, Ohio

[22] Filed: Sept. 26, 1975

[21] Appl. No.: 617,040

Related U.S. Application Data

[62] Division of Ser. No. 451,296, March 14, 1974, Pat. No. 3,951,397.

[52] U.S. Cl. ..... 270/31; 101/288

[51] Int. Cl.[2] ..... B65H 29/46

[58] Field of Search ..... 270/1, 30–31; 101/124, 116, 117–122, 128.2, 292, 288; 26/53; 8/62

[56] References Cited

UNITED STATES PATENTS

| | | | |
|---|---|---|---|
| 2,756,992 | 7/1956 | Rosenthal | 270/1 |
| 3,279,370 | 10/1966 | Bunce | 101/292 |
| 3,540,375 | 11/1970 | Alton | 101/292 |

*Primary Examiner*—Edgar S. Burr
*Assistant Examiner*—A. Heinz
*Attorney, Agent, or Firm*—McNenny, Pearne, Gordon, Gail, Dickinson & Schiller

[57] ABSTRACT

A method and means for shade marking a fabric web as it is machine spread on a cutting table wherein identifying marks are applied by intermittent stamping action while uniform web discharge speed and tension are maintained by a variable length web feeding path on the machine. Stamping of the web and variation of the feed path length are accomplished by power actuator means controlled by means responsive to pattern coordinating means arranged along a work area on the cutting table to ensure marking of the areas of substantially all of the pattern pieces to be cut without unnecessary multiple marking of such pieces.

6 Claims, 7 Drawing Figures

Fig. 5
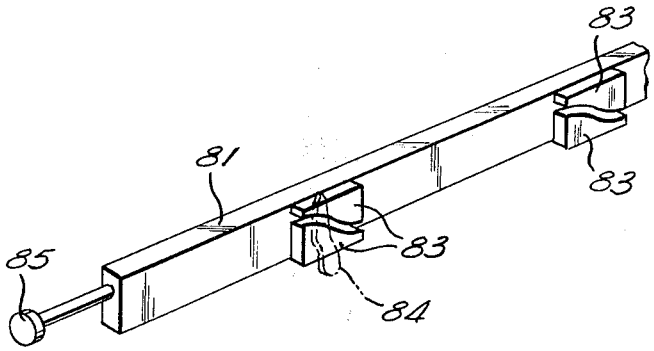
Fig. 4
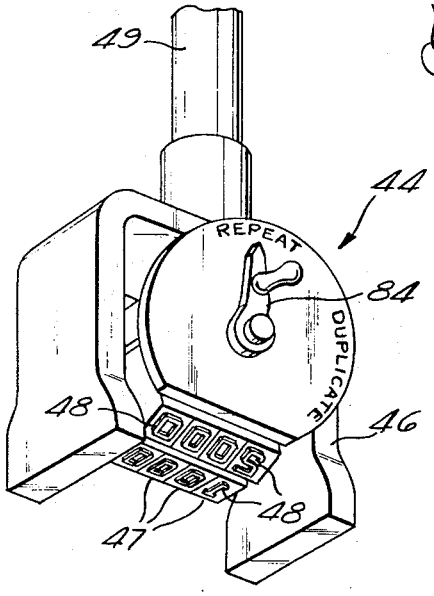
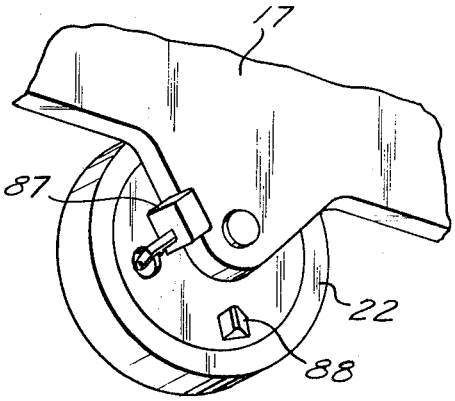
Fig. 7
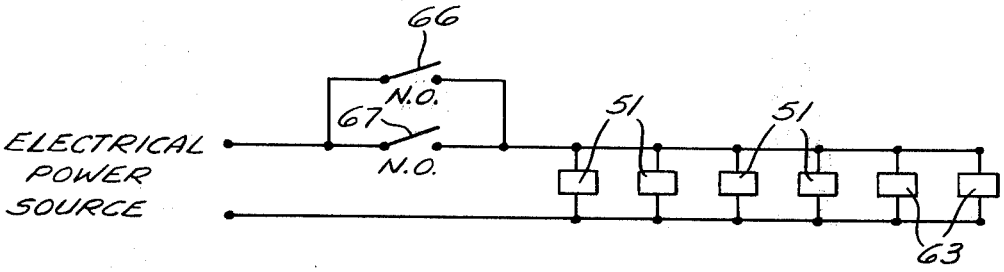
Fig. 6

SHADE MARKING MACHINE

This is a division of application Ser. No. 451,296 filed Mar. 14, 1974, now U.S. Pat. No. 3,951,397.

BACKGROUND OF THE INVENTION

The invention relates to a method and apparatus for shade marking a web spread into layers and, more particularly, for marking areas of successive layers with an image indicating their respective layer.

PRIOR ART

In volume production of wearing apparel, web material or fabric is spread on a cutting table in multiple layers which are subsequently cut together into pattern pieces. A bolt or roll of material often varies gradually along its length in its color shade. Areas of the web displaced from one another a substantial distance, in comparison to the length of the cutting table, for example, may have a readily perceptible difference in shade. Customarily, to avoid assembly of multishaded apparel articles, pieces cut from the pile of layers or "spread" are identified according to layers to permit them to be later selected and assembled with pieces of a common layer and therefore of substantially the same shade.

Manual shade marking is usually time-consuming, tedious, and susceptible to error. Prior developments in automating the shade marking process with spreading operations have had limited success. An approach to automating the marking process is disclosed in U.S. Pat. Nos. 2,756,992 and 2,783,993. A problem encountered in the use of the apparatus and method shown in these patents is excessive drag on the spreading machine produced by forces developed in the elements associated with the marking device and its associated drive. This resistance to movement in a manually operated spreading machine causes undesirable operator fatigue and detrimentally increases tension in the goods being spread. Subsequent efforts to power a spreading machine and its associated marking apparatus to avoid problems of excessive tension have substantially increased the complexity of the entire machine and have not been completely satisfactory in operation.

In addition to these difficulties, apparatus disclosed in the above-mentioned patents is limited in its flexibility in marking various pattern layouts. Owning to the fixed relationship between the rotation of the wheels of the spreading machine and the marking cycle of the image producing elements, a change in the longitudinal spacing of the images applied to the web is not readily achieved. Variations in the size and arrangement of pattern pieces in a layout, both along a spread of goods and from one production run or "cut" to another, require a flexibility in marking frequency not achieved in the prior art, to ensure that each pattern piece is identified according to its layer with at least one mark while not applying excessive markings to the goods.

U.S. Pat. Nos. 1,605,991 to Shields and 2,326,459 to Hansen disclose means for printing images on a web, while Pat. Nos. 3,677,536 to Paterson and 2,659,597 to Shaak et al disclose apparatus for controlling slack and for controlling operations in a spreading machine, respectively.

SUMMARY OF THE INVENTION

The invention provides a method and means for automatically shade marking a web as it is discharged from a spreading machine, wherein the speeds and forces of the marking elements are independent of the speed and driving load of the machine. In accordance with the invention, the marking elements are intermittently driven in a stamping action which neither develops nor requires significant tension in the web other than that normally used to pull the web from the spreading machine. The length of a web feed path on the machine is caused to vary during the marking operation to permit the portion of the web at a marking station to stop instantaneously during the marking process, while allowing the machine to move over the work area and discharge the web at a substantially uniform rate.

In a preferred embodiment, the invention is applied to a manually moved spreading machine of otherwise typical construction. The shade marking apparatus of the invention utilizes an independent power supply, conveniently an electrical power source, for its energy requirements to avoid additional manual effort and to provide fast response of the marking apparatus.

In a manner similar to that of a typical manual spreading machine, a web is drawn through a feeding path on the machine as the machine moves away from a clamped end of a layer being spread. In accordance with the invention, the feed path on the machine includes a loop of variable length which, as disclosed, is defined by a movable rod. At a proper time, power operated marking means engages the web against a platen to positively mark the web according to layer. Simultaneously with operation of the marking means, the movable rod is displaced by a power operated actuator to shorten the feed path to release a limited length of web. This action allows a uniform rate of discharge from the machine, and allows the area of the web being marked to stop instantaneously relative to the marking platen for reliable and uniform marking.

An important aspect of the invention is the coordination of the marking apparatus to the particular pattern arrangement to be cut from the spread of web material. By such coordination, positive marking of each pattern piece is ensured, while excessive marking is avoided. This is accomplished by the invention where coordinating means is provided along the work area at lines across the web which intercept a maximum number of pattern pieces. As the spreading machine traverses the work area, means responsive to the coordinating means causes the marking means to be energized and the web to be marked across its width at locations corresponding to the selected intercepting lines.

BRIEF DESCRIPTION OF THE DRAWINGS

FIG. 4 is a perspective view of one of several shade marking devices provided on the spreading machine.

FIG. 5 is a perspective, fragmentary view of a control member for advancing images of the several marking devices.

FIG. 6 is a schematic, electrical circuit for energizing various actuators of the marking apparatus.

FIG. 7 is a perspective view of a modification of the preferred apparatus for controlling the marking operation.

DESCRIPTION OF THE PREFERRED EMBODIMENT

Figure 1:
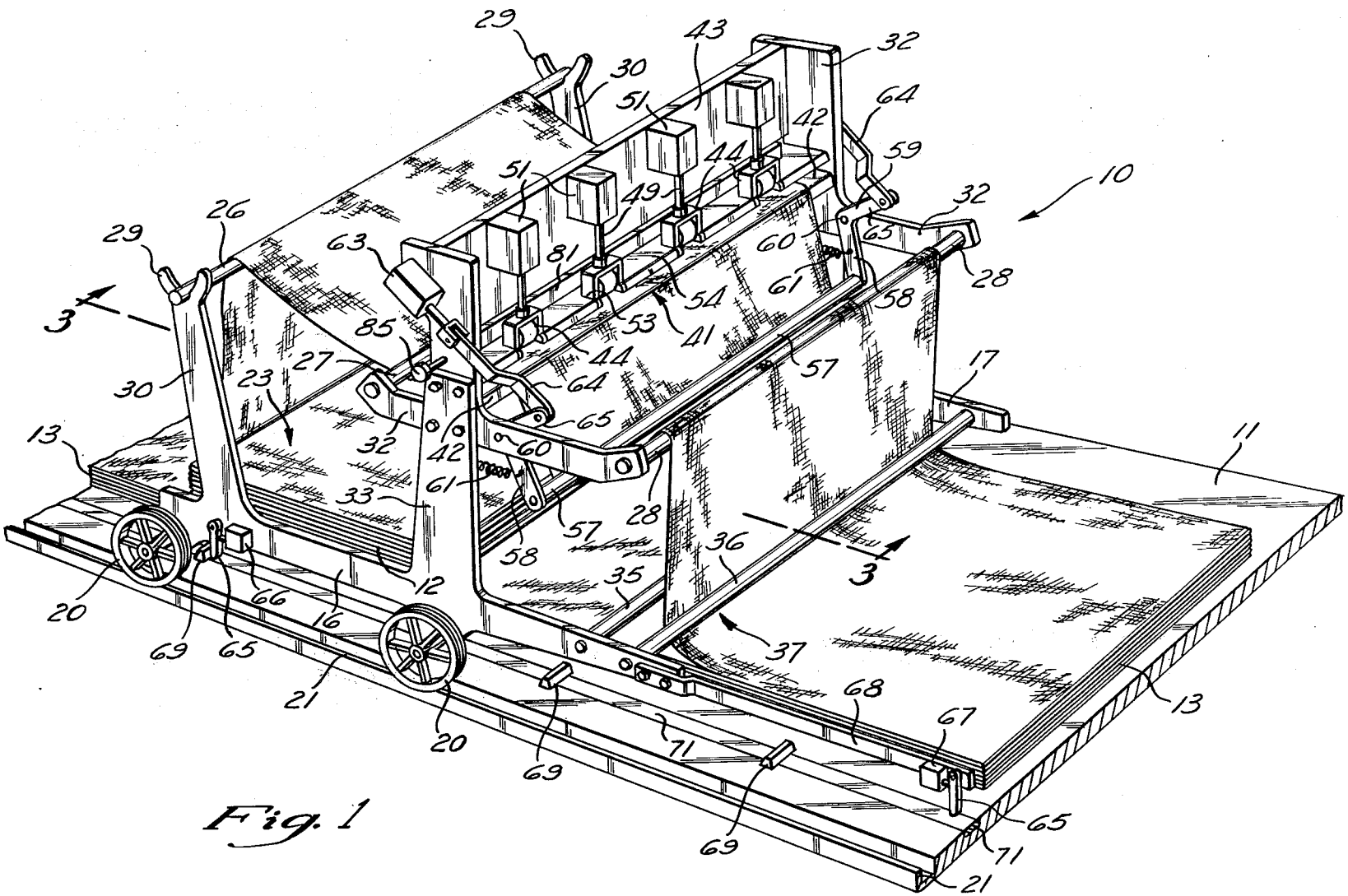
FIG. 1 is a perspective view of a spreading machine and associated apparatus embodying principles of the invention.

Referring to FIG. 1, there is shown a spreading machine 10 of generally conventional construction and adapted to be manually driven over a cutting table 11. The machine 10, carrying a web or fabric supply 12, is caused to reciprocate over the table 11 to pile successive layers 13 of the web in a work area on the table.

Figure 3:
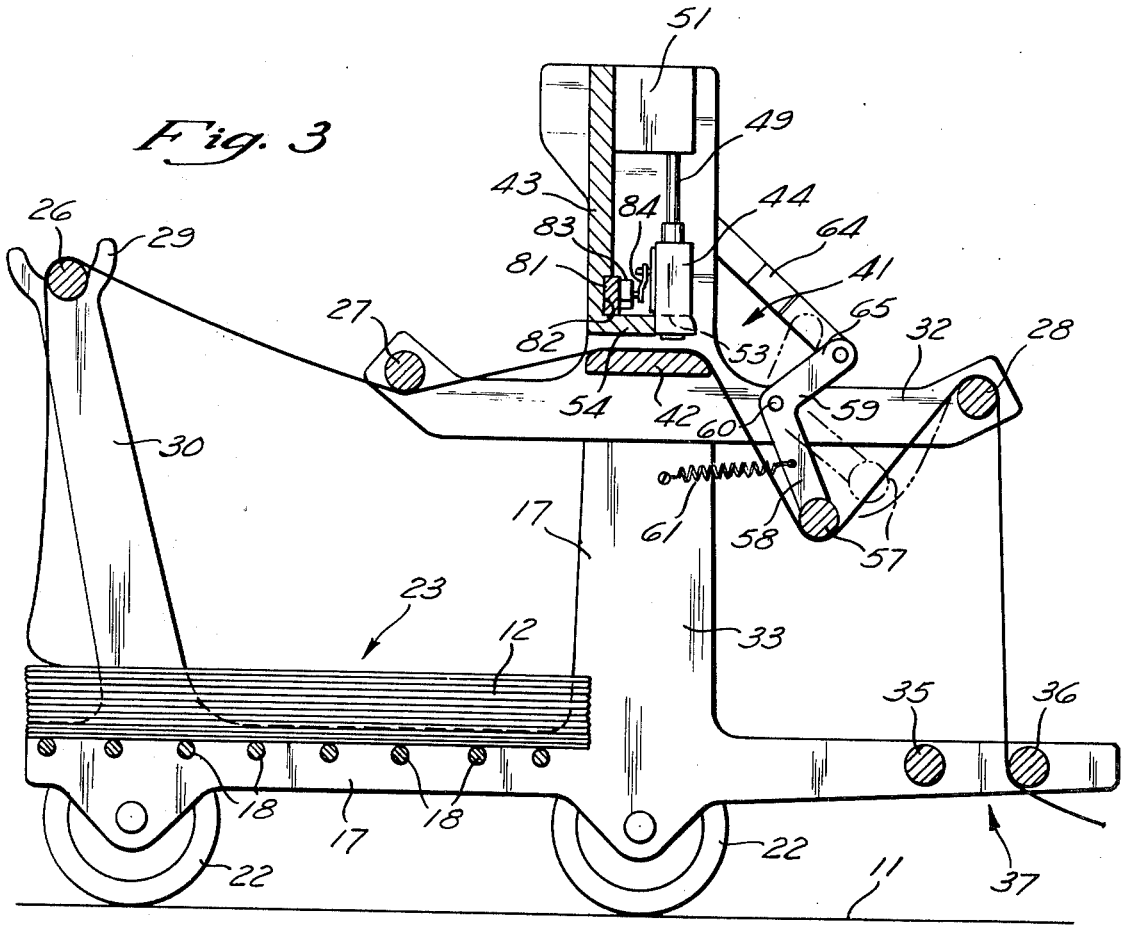
FIG. 3 is a cross sectional, elevational view of the spreading machine taken along the line 3—3 of FIG. 1.

The spreading machine 10 comprises a four-wheeled carriage having its body principally formed of a pair of opposed, generally planar, vertical side members 16 and 17 and a plurality of transversely extending bars 18 (FIG. 3) bolted or otherwise secured to the side members. A pair of grooved wheels 20 supporting the adjacent side frame member 16 lie on a longitudinal track 21 at an edge of the table 11. This side 16 of the machine is normally referred to as the front of the machine with regard to the normal walking path of an operator along the track 21. The opposite side 17 of the machine 10 is supported by a corresponding pair of wheels 22 (FIG. 3).

The supply of the web 12 is carried in a station, generally indicated at 23, formed over the transverse bars 18 between the side frames 16 and 17. The web 12 is fed along a path defined by a series of transverse guide rods 26, 27, and 28. The rods 26-28 may preferably be rotatably mounted at their respective ends on the machine 10 to minimize frictionally induced drag and resulting tension in the web 12. As viewed in FIGS. 1 and 3, the leftward or first rod or roller 26 is supported in yoke portions 29 of a pair of uprights 30 of the side frames 16 and 17. Where the goods to be spread are supplied in roll form, the roll may be rotatably mounted on the roller 26 with the web being fed off the roll to the underside of the second roller 27.

The second and third rollers 27 and 28 are mounted on a pair of opposed, horizontally extending brackets 32 bolted to adjacent main uprights 33 of the side frames 16 and 17. After passing over the rightward roller 28, the web 12 is threaded through a pair of drop-off rollers 35 and 36 forming a discharge station, generally indicated at 37, of the machine 10. A web marking station 41 is arranged between the guide rollers 27 and 28 in the area of the main uprights 33.

The marking station 41 includes a platen 42 extending horizontally between the brackets 32. A cross tie or plate 43 extends above the platen 42 between the brackets 32 and supports a plurality of marking devices 44 in a line transverse to the web path over the platen 42. A perspective view of a typical marking device 44 is illustrated in FIG. 4. The device 44 is conveniently provided as a commercial numbering stamp, such as manufactured by The Bates Manufacturing Company, of Orange, New Jersey. The numbering device 44 includes a U-shaped body 46 containing numbering wheels 47 having raised printing characters or digits 48. The printing characters 48 are automatically inked by a pivoted pad (not shown) when the wheels 47 are in the illustrated retracted position. A stem 49, normally fitted with a handle, is fixed to the armature (not shown) of an associated solenoid actuator 51. The stem 49 is slidable into the body 46 against the force of a retraction spring (not shown) to move the wheels 47 relative to the body. The body 46 of each marking device 44 is vertically, slidably supported in an associated slot 53 in a horizontally extending leg 54 of the cross plate 43. When the actuators 51 are energized, the stems 49 of the marking devices 44 are driven downwardly to cause the U-shaped body to engage the web 12 in a perpendicular direction against the platen 42 and the wheel marking or printing surfaces 48 in an imaging movement to transfer an ink image to the web.

A loop forming and control rod 57 is supported at its ends in a set of depending legs 58 of a pair of opposed bell cranks 59. The bell cranks 59 support the rod or roller 57 for pivotal movement on the machine 10 about the horizontal axis defined by pivot pins 60. The bell cranks 59 and loop control rod 57 are biased downwardly to their illustrated positions, forming a major loop length, by a pair of tension springs 61 anchored to the main uprights 33. A pair of solenoid actuators 63 (only one is seen in FIG. 1) mounted on the outside faces of the brackets 32 are adapted to positively retract the control rod 57 to a position indicated in phantom in FIG. 3 corresponding to a minor loop length. The actuators 63 draw a pair of associated tension rods 64 connected to a pair of generally upstanding legs 65 of the bell cranks 59.

The web marking and loop control actuators 51 and 63 are operated by either of two electrical limit switches 66 and 67 carried by the spreading machine immediately above the table 11. The limit switch 66 is secured directly to the front frame member 16, while the limit switch 67 is secured to an extension bracket 68 bolted to the front frame member. FIG. 6 schematically illustrates an electrical circuit showing the connection of the switches 66 and 67 between an electrical power source, such as a utility power line, and the various actuators 51 and 63. The limit switches 66 and 67 and associated pivot arms 65 are arranged to sense the presence of pattern coordinating elements 69 placed at advantageous locations along the path of the machine 10 on a steel strip 71 embedded in the table 11.

Figure 2:
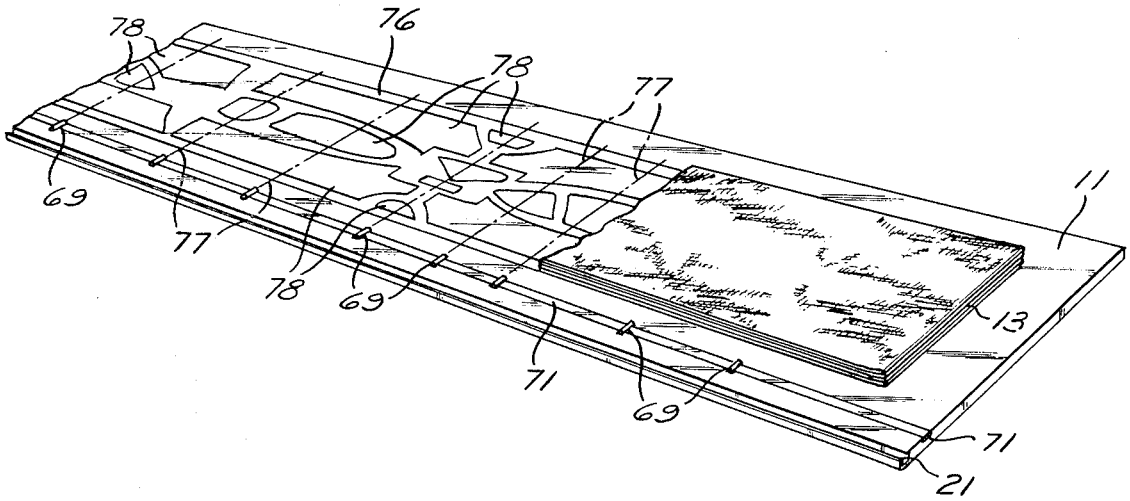
FIG. 2 is a fragmentary, perspective view of a portion of a cutting table on which a pattern cutting plan and a spread of fabric web are shown.

The active work area on the table, i.e., the length of a spread, is normally defined by the length of a particular cutting pattern, or multiples of the length of the cutting pattern. A cutting pattern 76, as partially shown in FIG. 2, may be initially positioned on the table 11 to determine the spread length and determine an arrangement of pattern pieces 78 and then removed prior to the actual spreading operation. Before removal of the cutting pattern, in accordance with an important aspect of the invention, the pattern coordinating elements 69, ideally in the form of blocks of permanent magnetic material, are positioned at advantageous points along the work area.

Ideally, the location of the elements 69 is determined by visual inspection of the pattern and the selection of points on the steel strip 71 from which imaginary lines 77, extending transversely across the pattern 76, intercept a maximum number of pattern pieces 78 ordinarily without missing a piece and without unnecessarily crossing any of the pieces with a plurality of lines. The use of magnetic force is particularly suited for holding the elements 69 along the work area, since it allows the elements to be readily repositioned substantially anywhere along the length of the table 11 when a different pattern is to be cut.

In operation, the spreading machine 10 is manually driven over the table 11 alternately from one end of a work area to the other. As the machine 10 reverses direction, a fold is formed and a new layer is initiated. The lead end and subsequent folds between each layer are clamped or otherwise held at their associated ends of the work area by conventional means, not shown.

As the machine 10 moves, the web 12 is drawn from the supply station 23 through the feeding path on the machine. As one or the other switch 66 or 67 is tripped by one of the coordinating elements 69, all of the actuators 51 and 63 are instantaneously energized to mark the web and release the web loop. Feeding movement of the web through the drop-off rollers 35 and 36 is thus maintained at a constant rate without an increase in web tension, while the web portion on the platen 42 is momentarily brought to a stop by a natural braking action of the bodies 46 and marking surfaces 48 as they engage the web in a stamping motion. The sensing arms 65 are pivoted on opposite sides of the switches 66 and 67 in a manner which makes the left-hand switch 66 active and the right-hand switch inactive when the machine 10 is moving to the left and vice versa when the machine is moving to the right. The distance between either of the switches 66 or 67 and the discharge station 37 is arranged to be approximately equal to the length of the web portion between the discharge station 37 and the printing station 41 so that the line of marks produced by the marking devices 44 eventually aligns with the relevant coordinating element 69 causing the marking operation.

The number and spacing between the marking devices 44 are selected by considering the average size and arrangement of the pattern pieces to be cut from material spread by the machine in question. Ordinarily, the marking devices 44 are arranged to simultaneously produce identical images. Where each layer in the pile 13 is to be marked with a separate image, e.g., a consecutive number, a marking device control 81 (FIGS. 3 and 5) is operated at the end of each pass of the machine 10. The control 81 is shifted transversely in a slot 82 on the cross bar 33 by manually engaging a knob 85. A pair of cam blocks 83 on the control 81 associated with each marking device 44 operate a shifting lever 84 (FIG. 4) to cuase the numbering wheels 47 to shift one digit upon actuation of one of the switches 66 and 67.

An alternative arrangement for controlling the actuators 51 and 63 is illustrated in FIG. 7. In this embodiment, the mentioned switches 66 and 67 are replaced by a switch 87 and the pattern coordinating means 69 are replaced by a cam 88 fitted to one of the wheels 22. Rotation of the wheel 22 and corresponding angular displacment of the cam 88 cause the switch 87 to be closed and the actuators 51 and 63 to be energized periodically with each revolution of the wheel. The resulting mark applied by the devices 44 will appear on transverse lines across the web 12 longitudinally spaced from each other a distance equal to the circumference of the wheel 22. Where other spacings are desired, multiple cams or a fixed ratio rotary drive between the wheel and cam may be provided. The embodiment of FIG. 7 may be employed where it is not necessary to minimize the number of marks, or where it is not necessary to ensure that all of the pattern pieces be marked.

Although preferred embodiments of the invention have been illustrated and discussed, it is understood that various modifications and rearrangements may be restored to without departing from the scope of the invention. It is contemplated, for example, that various elements and functions of either the marking station or the loop control apparatus may be embodied as an attachment for existing web spreading machines.

I claim:

1. A method of identifying successive layers of a web for shade marking, comprising the steps of defining a work area having two ends, conveying a web supply in a carriage over the work area by manually moving the carriage alternately from one end of the work area to the other, feeding the web along a path including a loop on the carriage in a manner which permits the loop to change in length, stamping a plurality of areas of each layer with a layer identifying image by bringing a marking medium into contact therewith by relative normal imaging movement between the marking medium and the web, allowing an area of the web being marked to instantaneously stop in its feeding movement along the feed path on the carriage by a change in the length of the loop, whereby said stamping step is performed by operations conducted on said carriage without substantially affecting the forces required to move the carriage over the work area, the web being normally drawn into the loop on the carriage by a tension-biased loop forming member and being positively released with the initiation of imaging movement between the web and the marking medium.

2. A method of shade marking a web to identify pattern pieces of a particular layer of the web, comprising the steps of defining an arrangement of pattern pieces to be cut from a layer of web material, spreading web material in successive layers on a work area by feeding it from a carriage reciprocating over the work area, marking successive layers at points along lines transverse to the web length, the longitudinal location of said lines relative to one another and the defined pattern arrangement being selected to provide at least one mark on each of said pattern pieces, arranging pattern coordinating means along the work area at locations corresponding to said transverse lines, and sensing said coordinating means by means on the carriage to automatically actuate a marking device on the carriage as said carriage passes said coordinating means.

3. The method as set forth in claim 2, wherein said web is fed through a loop path on said carriage, and said loop path is allowed to shorten during a marking operation to permit a variation in a feed rate of the web material at a marking station and a substantially uniform feed rate of the web material at a discharge station.

4. The method as set forth in claim 3, wherein the loop of the web is positively released at the marking station to minimize variation in tension in the web as it is spread over said work area.

5. The method as set forth in claim 4, wherein said web is marked by applying an image thereto with stamping means engaging the web on the machine in a direction normal to its face.

6. A method of shade marking areas of successive layers of a web to be cut into pieces on an elongated work area according to a predetermined pattern, comprising the steps of providing pattern coordinating means along the work area at selected points on lines transverse to a longitudinal web direction and spaced from one another in a manner which causes substantially all of the pattern pieces to be crossed by a line without unnecessary multiple crossing of one piece by such lines, spreading the web on the work area in successive layers by feeding it from a carriage reciprocating over the work area, the web being fed from a supply station to a marking station and then through a variable loop length to a discharge station on the carriage, stamping layer identifying images at transversely spaced locations across the web at the marking station and simultaneously allowing its web loop length to decrease as sensing means on the carriage responds to the presence of said coordinating means as said carriage moves over said work area, whereby the web areas of substantially all of the pattern pieces are marked with a layer identifying image and whereby through variation in the web loop length, the feed rate of the web from the discharge station to the work area is maintained substantially constant while the feed rate of the web portion being marked at the marking station decreases during the marking operation.

* * * * *